US008650779B1

(12) United States Patent
Glass et al.

(10) Patent No.: US 8,650,779 B1
(45) Date of Patent: Feb. 18, 2014

(54) GIFT CARD HOLDER FOR A FLORAL ARRANGEMENT

(71) Applicant: Gift Card Impressions, LLC, Overland Park, KS (US)

(72) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/720,993

(22) Filed: Dec. 19, 2012

(51) Int. Cl.
*G09F 1/00* (2006.01)

(52) U.S. Cl.
USPC ..... 40/124.06; 40/124.08; 40/124.11; 40/645

(58) Field of Classification Search
USPC ..... 40/124.06, 124.08, 124.09, 124.11, 40/645, 642.01
See application file for complete search history.

(56) References Cited

U.S. PATENT DOCUMENTS

| | | | | |
|---|---|---|---|---|
| 5,167,086 | A * | 12/1992 | Fast | 40/673 |
| 5,383,292 | A * | 1/1995 | Whittredge | 40/124.08 |
| 6,195,926 | B1 * | 3/2001 | Jarl et al. | 40/645 |
| 8,474,619 | B1 * | 7/2013 | Chrisman | 206/449 |
| 8,499,478 | B1 * | 8/2013 | Glass et al. | 40/124.14 |
| 2006/0005438 | A1 * | 1/2006 | Chang et al. | 40/124.09 |

* cited by examiner

*Primary Examiner* — Gary Hoge
(74) *Attorney, Agent, or Firm* — Polsinelli PC

(57) ABSTRACT

A transaction card holder for holding a transaction card to an elongate structure, such as a flower stem associated with a floral arrangement. The transaction card holder includes a pocket for holding the transaction card and a clip projecting from the holder to engage the elongate structure. A transaction card holder assembly includes a transaction card holder secured to a backer for displaying the holder at a point of sale.

9 Claims, 7 Drawing Sheets

GIFT CARD HOLDER FOR A FLORAL ARRANGEMENT

BACKGROUND OF THE INVENTION

This invention relates generally to transaction card holders and more particularly to a device for holding a transaction card, such as a gift card, upon a plant stem, e.g. flower stem, or other elongate structure in a floral arrangement.

Transaction cards, stored value cards, or gift cards as they are commonly called based upon their intended use, have become popular gifts. Gift cards typically comprise a stored value card whereby a certain cash equivalent value is associated with a code or data stored upon a magnetic strip applied to the surface of the card. This stored value may be determined by the vendor prior to packaging and display for sale or is selected at the point of sale by the purchaser and loaded using a magnetic card reader/writer. While popular, gift cards are typically provided with a generic and impersonal design, typically identifying the associated merchant for which the card may be used to purchase merchandise and, therefore, may not be perceived as special or conveying sentiments to the recipient. Devices for holding gift cards (gift card holders), typically in the general shape and structure of a greeting card, are known to be used to augment the gift of a transaction card by providing a surface for displaying decorations, images, or messages.

Gift cards, as offered for sale individually or in a pack, and either with or without an associated holder, (collectively, "gift card package") are often required to fit within a set, allocated space in pre-existing store displays. Typically, the gift card package must not exceed 5.25" tall and 4" wide. These dimensions are an industry standard and are typically non-negotiable. In order to properly hang each gift card package, it typically includes a J-hook hole (sombrero cut) with the exact dimensions of 1.875" wide by 0.5" high and is placed 0.1875" from the top of the package. Presently, the above requirements pertain to approximately 95% of all gift cards as packaged for retail sale.

Expressing sentiments, particularly in conjunction with an event or remembrance, often includes gifting flowers and/or floral arrangements. Although gift cards have become common gift items, they are not commonly incorporated into a floral arrangement and, if so, are typically only placed into an envelope which is clipped onto a stake or pick. The gift card, therefore, is attached to the arrangement in a functional manner without significantly enhancing the presentation or decorative aspect of the arrangement.

What is needed, therefore, is a gift card holder that further decorates and enhances the presentation of the floral arrangement, thereby enhancing the perceived value of the gift card to the recipient and among the gift card purchasing public. It should be appreciated that the terms "gift card" and "transaction card" are used interchangeably herein, the term "gift card" conveying a common but not requisite use of a transaction card as a gift item. The terms "typically", "generally", "essentially" and "substantially" may be used when describing embodiments of the invention disclosed herein, and convey that a structure or function may occur in one more embodiments, but not necessarily in every embodiment, and that the invention is not limited by such disclosure.

BRIEF DESCRIPTION OF THE INVENTION

The purpose of this invention is to provide an assembly including a device for holding a transaction card, such as a gift card, to an elongate structure; namely, to an elongate structure, such as a flower stem, associated with a floral arrangement. An embodiment of a transaction card holder assembly includes a transaction card holder and a backer. The transaction card holder includes a main body including a first major panel and a second major panel. The first major panel and second major panel are typically, but not necessarily, of the same or similar dimensions and shape, and are typically each connected to a pocket therebetween to form a structure that is substantially symmetrical on either side of the longitudinal axis of the holder. More specifically, in an embodiment of the holder, the first major panel is connected to and along an outer edge of a first minor panel of an elongated pocket. The second major panel is connected to and along an outer edge of a second minor panel of the elongated pocket. The minor panels are connected to one another along, and share, a center edge. The inner surface of the center edge forms the bottom, inner surface of the pocket. The inner surfaces of the minor panels form inner wall surfaces of the pocket. The major panels are pivotable or foldable about the outer edges of the minor panels, which are defined by a crease or fold between each major panel and its adjoining minor panel. The pocket is of sufficient length or elongation to receive an edge of a transaction card between the minor panels. Typically, only a portion of the card is held within the pocket, with the remaining portion of the card projecting from the pocket and from the plane or planes of the major panels. In use, the major panels may be folded relative to each other to be co-planar or at any selected angle.

Certain embodiments of the holder include at least one aperture, and preferably two, in the center edge, or bottom of the pocket. A holder attachment clip is positioned within the apertures to project outwardly from the bottom of the pocket and, therefore, from the bottom of the holder. In certain embodiments, the clip is formed of a length of wire or other elongate, bendable, resilient material that is formed into a U-shape so that both ends may be passed from the interior of the pocket, through the apertures, and then to the exterior, bottom surface of the holder to engage with and serve as attachment means to a flower stem or other elongate structure of a floral arrangement.

A transaction card holder according to the present invention is typically placed for sale upon a display rack after assembling the holder with a backer. An elongated backer may comprise a main panel and a subpanel. The main panel includes an elongated slot therein of sufficient dimensions (sized) to receive a holder pocket within, and the subpanel is attached to the back surface of the main panel to substantially underlie the main panel. In certain embodiments, the subpanel is formed from an extension of the main panel that is folded underneath the main panel. To attach the holder to the backer, the first major panel is threaded though the slot and between the main panel and the subpanel to secure the main body to the main panel.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
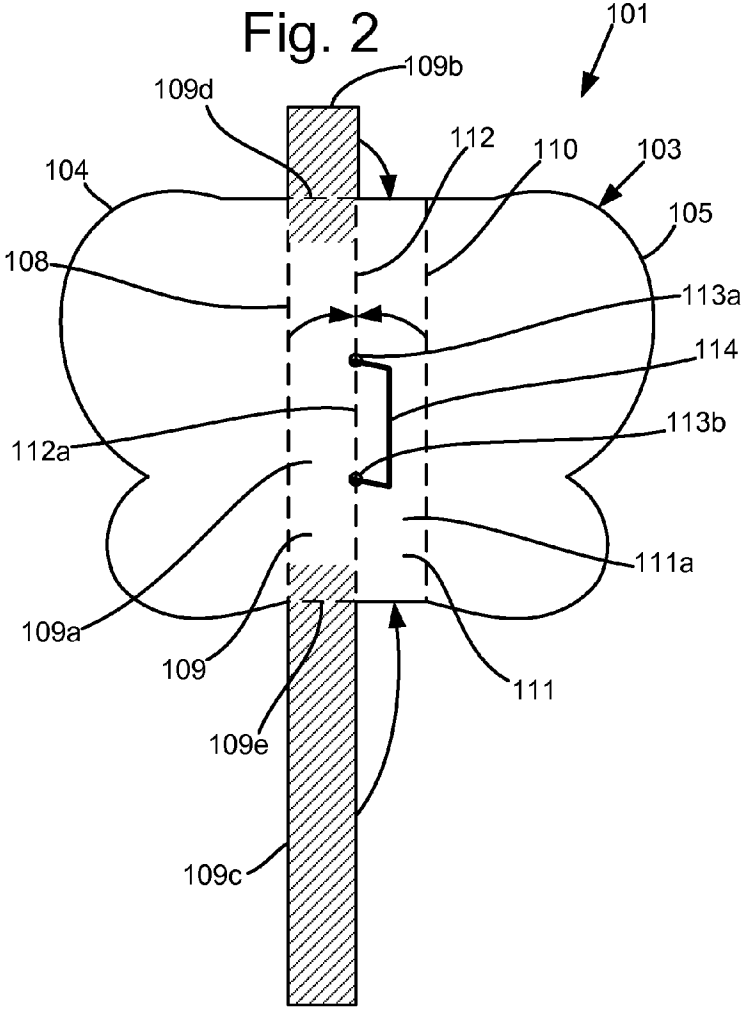
FIG. 2 is a plan view of the top surfaces of the main body of an unassembled card holder.
Figure 1:
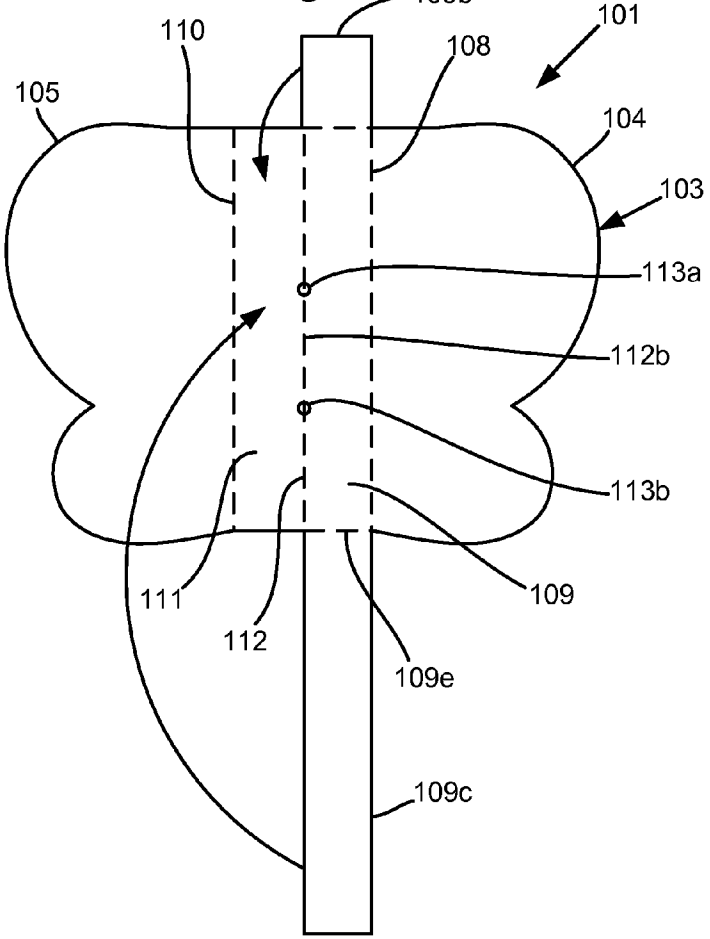
FIG. 1 is a plan view of the bottom surfaces of the main body of an unassembled card holder.

With reference to the figures, FIGS. 1-13 are illustrations of one or more embodiments and elements of a transaction card holder assembly 100. The assembly 100 includes a transaction card holder 101 for holding a transaction card 102 (see FIGS. 11, 12 and 13), such as a gift card, to an elongate structure, such as a stake, pick or flower stem, associated with a floral arrangement. The holder 101 includes a main body 103, which includes a first major panel 104 and a second major panel 105. The first major panel 104 and second major panel 105 are typically of the same or similar dimension and shape and are typically each connected to an elongated pocket 106 (see FIGS. 9 and 10), located therebetween and along the longitudinal axis 107 of the holder 101 (see FIG. 9). After assembly, the main body 103 is, therefore, substantially symmetrical on either side of the longitudinal axis 107. The pocket 106 is elongated along the longitudinal axis 107. FIG. 1 is a plan view of the bottom surfaces of the main body 103 of an unassembled holder 101, including the first major panel 104 and second major panel 105. FIG. 2 is a plan view of the top surfaces of the main body 103 of an unassembled holder 101, including the first major panel 104 and second major panel 105.

The first major panel 104 is connected to and along an outer edge 108 of a first minor panel 109 of the pocket 106. The second major panel 105 is connected to and along an outer edge 110 of a second minor panel 111 of the pocket 106. The minor panels 109 and 111 are connected to one another along, and share, a center edge 112. The inner surface of the center edge 112 is the inner bottom surface 112*a* of the pocket 106. The outer surface of the center edge 112 is the outer bottom surface 112*b* of the pocket 106. The inner surfaces of the minor panels 109 and 111 form inner wall surfaces 109*a* and 111*a* (respectively) of the pocket 106. The major panels 104 and 105 are pivotable or foldable about the outer edges 108 and 110 of the minor panels 109 and 111, which are defined by a crease or fold between each major panel 104 and 105 and its adjoining minor panel 109 and 111.

The main body 103, and particularly the pocket 106, is assembled using a first tab 109*b* and second tab 109*c* each extending from longitudinally opposing ends of the first minor panel 109. The tabs 109*b* and 109*c* each bear adhesive (indicated by shading in FIG. 2) on interior surfaces (also top surfaces as shown in FIG. 2) thereof. The adhesive extends a relatively short distance onto the longitudinal ends of wall surface 109*a* so that when wall surfaces 109*a* and 111*a* are folded or brought together during assembly, the adhesive surfaces of 109*a* adhere to contacted portions of surface 111*a*, thereby holding minor panels 109 and 111 in a folded, operative position and forming the pocket 106. To further hold the pocket minor panels 109 and 111 in the folded position, tab 109*b* is folded along fold line 109*d* to contact and adhere to an underlying outside surface of minor panel 111. Tab 109*c* is folded along fold line 109*e* to contact and adhere to an underlying outside surface of minor panel 111.

Figure 9:
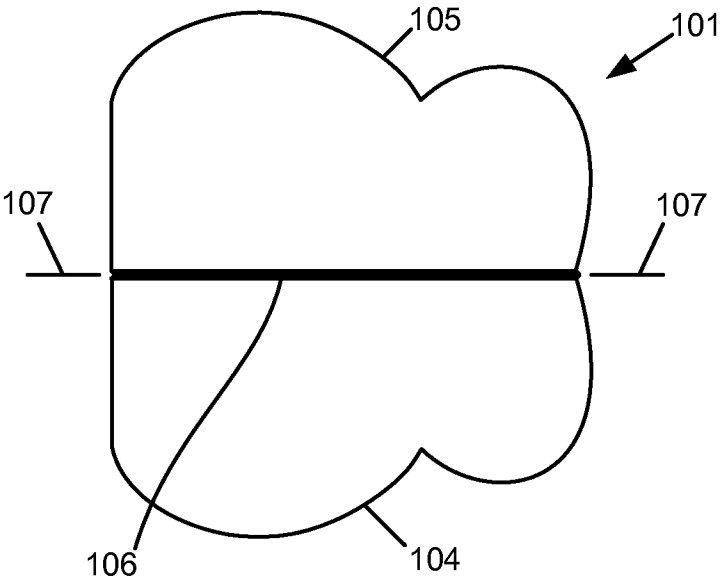
FIG. 9 is a plan view of the top surfaces of the main body of a card holder.
Figure 10:
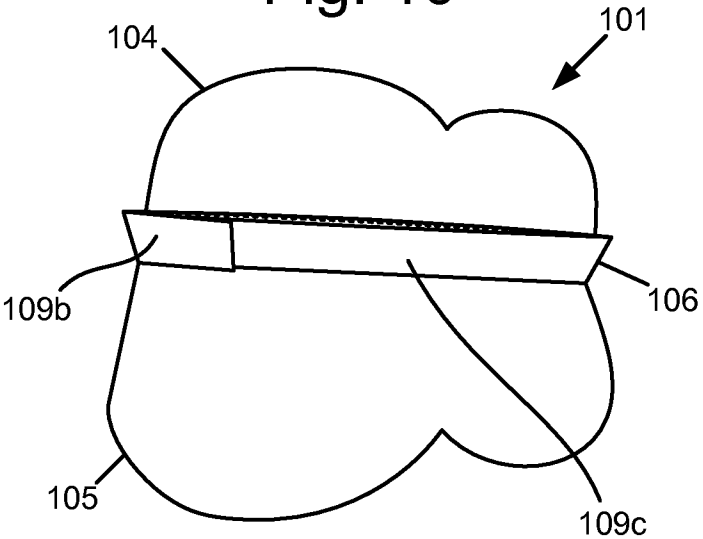
FIG. 10 is perspective view of the bottom surfaces of the main body of a card holder.
Figure 12:
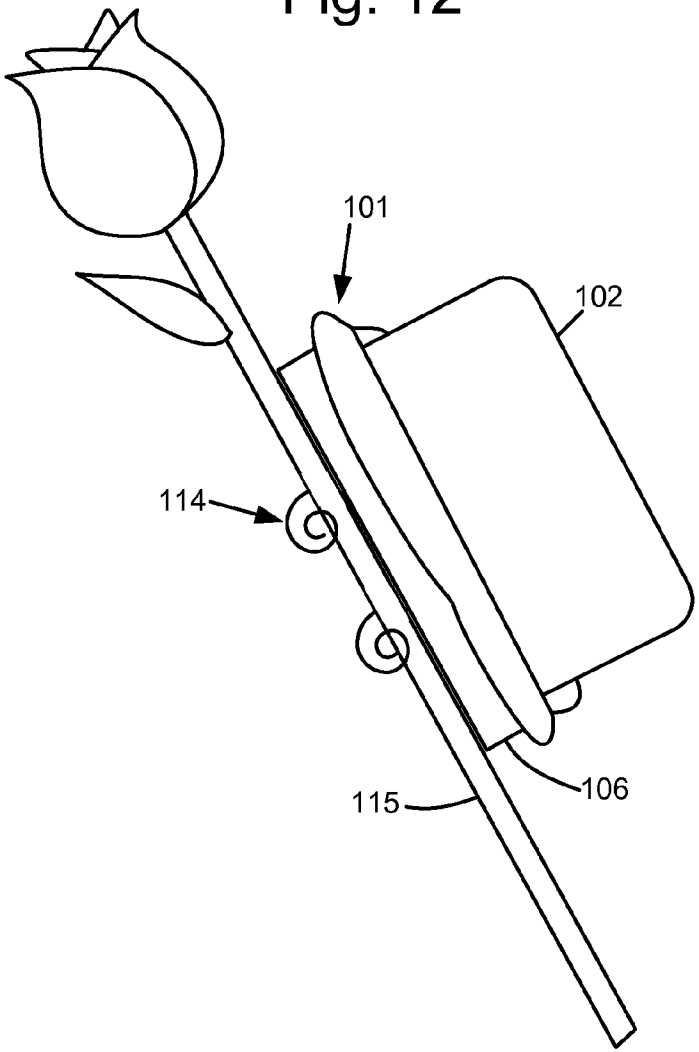
FIG. 12 is an elevational view of a card holder attached via the holder clip to the stem of a flower.
Figure 11:
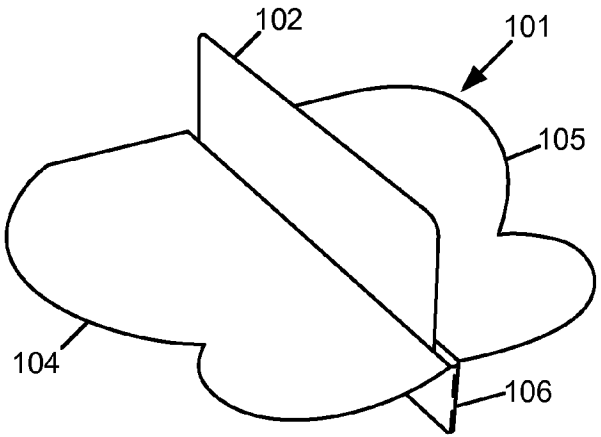
FIG. 11 is a perspective view of the top surfaces of the main body of a card holder showing a card positioned within the pocket thereof.
Figure 13:
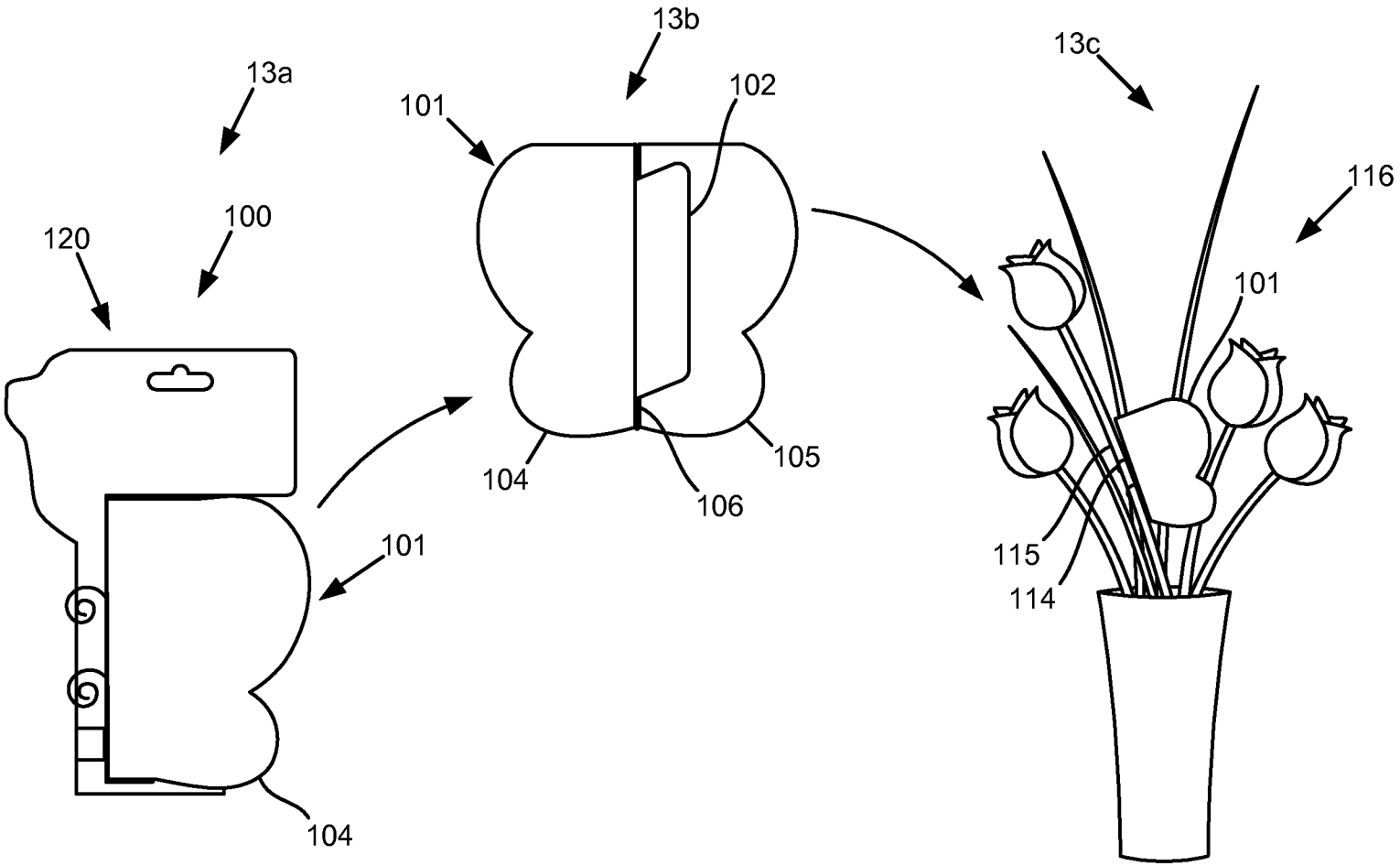
FIG. 13 is a series of three views showing the progression from a card holder attached to a backer, to a card holder removed from a backer and a card installed within the holder pocket, to a card holder clipped to the step of a flower in a floral arrangement.

The pocket 106 is of sufficient elongation to receive an edge of a transaction card 102 between the minor panels 109 and 111, as shown in FIGS. 11, 12 and 13. Typically, only a portion of the card 102 is held within the pocket 106, with the remaining portion of the card 102 projecting from the pocket 106 and from the plane or planes of the major panels 104 and 105. In use, the major panels 104 and 105 may be folded relative to each other to be co-planar, as shown in FIGS. 9 through 11, or at any selected angle.

Certain embodiments of the holder 101 include at least one aperture 113, and preferably two apertures (i.e. aperture 113*a* and aperture 113*b*, referred to collectively by reference number 113), through the bottom surfaces 112*a* and 112*b* of the pocket 106. A holder attachment clip 114 (see FIG. 3) is positioned within the apertures 113. In certain embodiments, the clip 114 is formed of a length of wire or other elongate, bendable, resilient material that is formed into a U-shape so that both ends 114*a* and 114*b* of the clip 114 may be passed from the interior of the pocket 106, through the apertures 113, and then to the exterior, bottom surface 112*b* of the holder 101 to serve as attachment means to a flower stem or other elongate structure 115 of a floral arrangement 116 (see FIG. 12).

Figure 5:
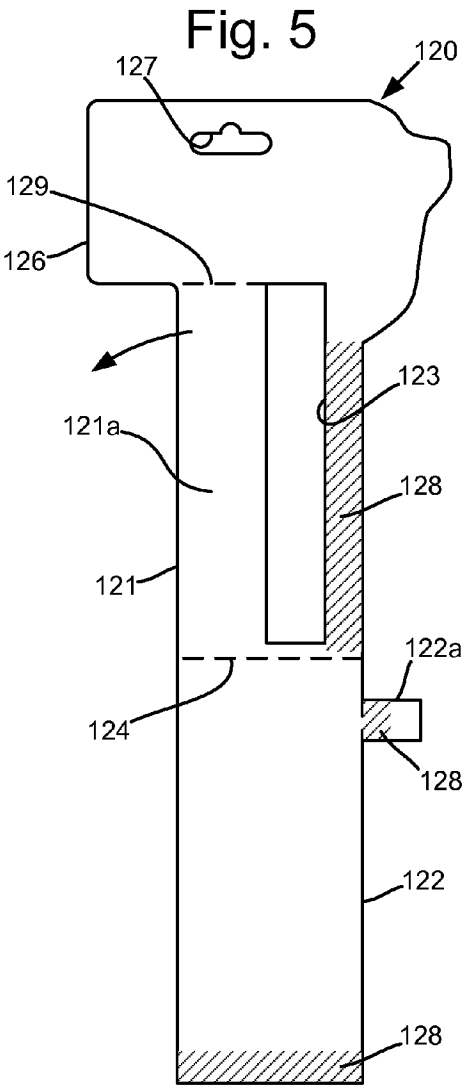
FIG. 5 is a plan view of the inner surfaces of a backer.
Figure 4:
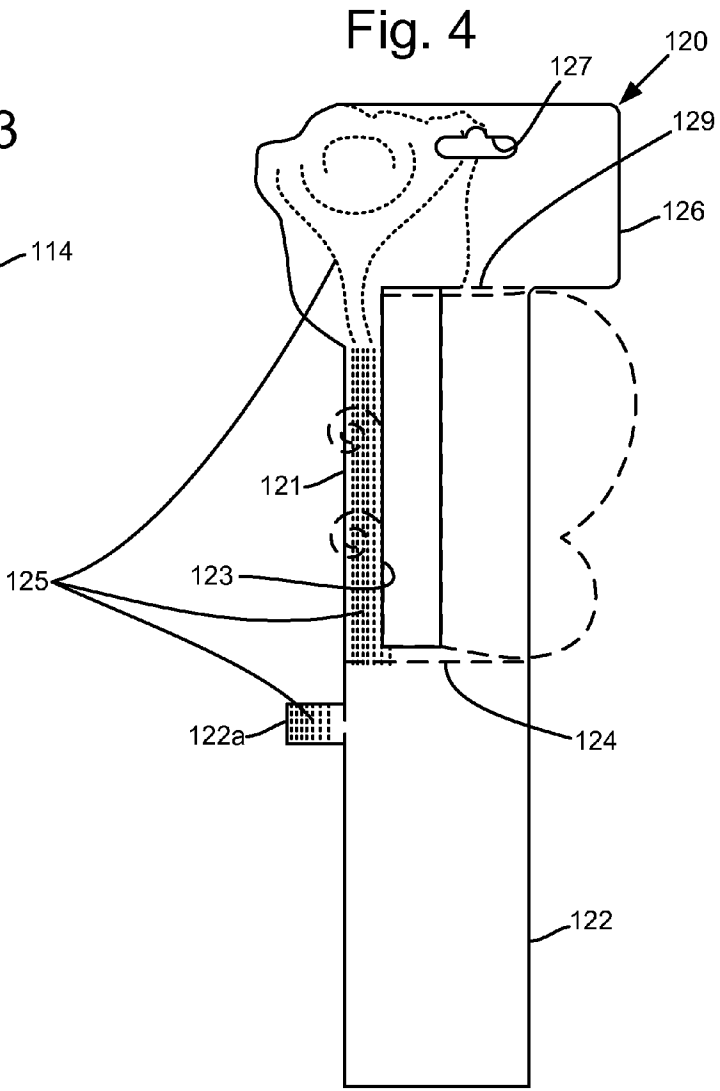
FIG. 4 is a plan view of the outer surfaces of a backer.
Figure 3:
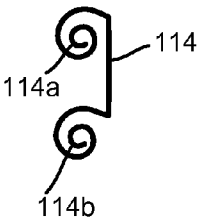
FIG. 3 is a plan view of a clip.
Figure 7:
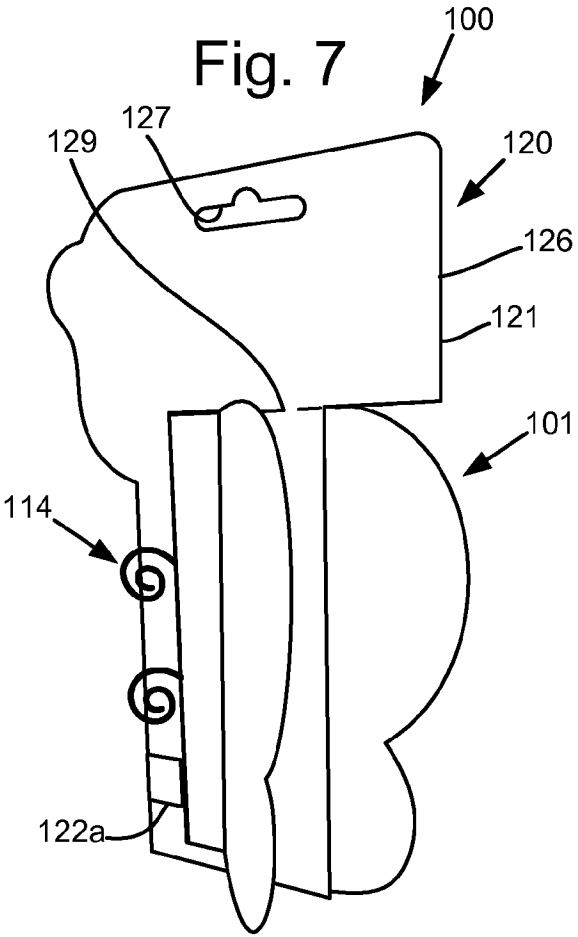
FIG. 7 is a front, right, perspective view of a card holder fully engaged with a backer with the major panels of the holder spread apart slightly to show portions of the backer positioned therebetween.
Figure 6:
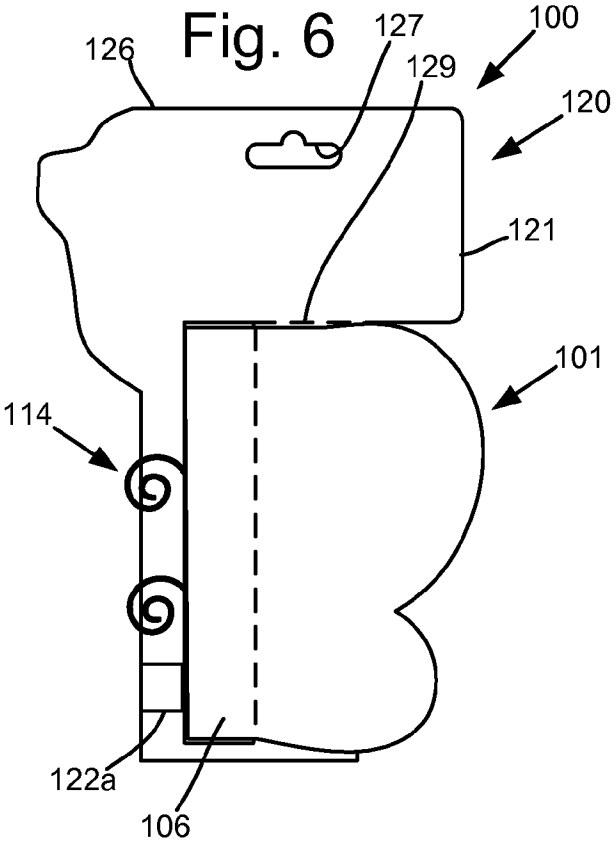
FIG. 6 is a plan view of a card holder fully engaged with a backer.
Figure 8:
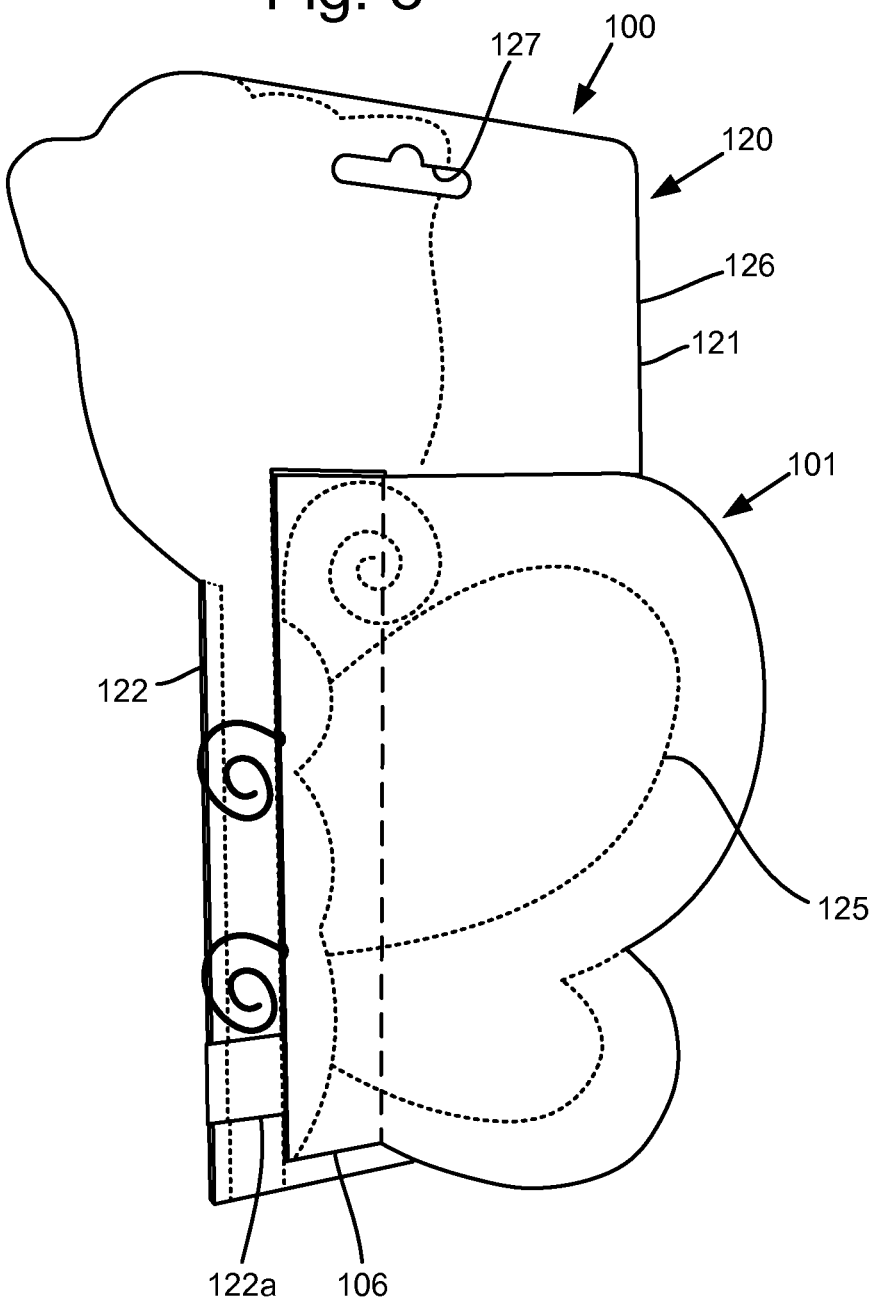
FIG. 8 is a front, left, perspective view of a card holder fully engaged with a backer.

A transaction card holder assembly 100 also includes a backer 120 for supporting a holder 101 prior to sale. A transaction card holder 101 according to the present invention is typically placed for sale upon a display rack (not shown) after assembling the holder 101 with the backer 120. The backer 120 may be provided with a header portion 126 including an hole 127, such as a sombrero cut hole 127, for receiving a display stand peg (not shown). FIG. 4 is a plan view of the outer surfaces of the backer 120. FIG. 5 is a plan view of the inner surfaces of the backer 120. The backer 120 may comprise a main panel 121 and a subpanel 122. The main panel 121 includes a longitudinally elongated slot 123 therein, and the subpanel 122 is attached to the back surface 121*a* of the main panel 121, typically via adhesive 128, to substantially underlie the main panel 121. In certain embodiments, the subpanel 122 is formed from an extension of the main panel 121 that is folded along fold line 124 to lie underneath the main panel 121. Tab 122*a* extends from a side of the subpanel 122 and wraps around to adhere to the front of the main panel 121 as shown in FIGS. 6 through 8.

To attach the holder 101 to the backer 120, a major panel of the main body 103 (typically the second major panel 105) is threaded though the slot 123 and between the main panel 121 and the subpanel 122 (or prior to attachment of the subpanel 122 to the main panel 121) to secure the main body 103 to the main panel 121 and backer 120. FIGS. 6 through 8 show views of an assembly 100 including a holder 101 engaged with a backer 120.

The main panel 121 includes a line of perforations 129 running from a margin of the elongate slot 123 to a margin of the main panel 121. To remove the holder 101 from the backer 120, the main panel 121 may be cut or torn along the line of perforations 129 to open the slot 123 and release the transaction card holder 101 from the backer 120.

The first major panel 104 and a second major panel 105 of the holder 101 may take the shape of butterfly wings in certain embodiments. The major panels 104 and 105 and other structures of the main body 103 may bear text, images, or graphics (as indicated in broken lines 125) to enhance the decorative features and aspects of the holder 101. The backer 120 may also bear text, images, or graphics. FIG. 13 is a series of three views showing the progression from a card holder 101 attached to a backer 120 (see 13A), to a card holder 101 removed from a backer with a card 102 installed within the holder pocket 106 (see 13B), to a card holder 101 clipped to the stem 115 of a flower in a floral arrangement 116 (see 13C).

It should be appreciated that the main body 103 and backer 120 may be constructed of various types of paper, cardboard, card stock or plastics or other resilient materials and may bear various graphics and designs while maintaining the general structure and functionality described herein. Certain embodiments of the assembly 100 and any associated packaging are constructed and assembled to comply with standard space constraints for display upon store racks, and more particularly to not exceed 5.25 inches tall by 4 inches wide.

Having thus described the invention, what is claimed as new and desired to be secured by Letters Patent is:

1. A device for holding a transaction card to an elongate structure, the device comprising:

a transaction card holder including a main body, said main body including a first major and a second major panel each connected to a pocket therebetween, said major panels pivotable about the outer edges of said pocket, said pocket of sufficient length to receive an edge of a transaction card, and a clip projecting outwardly from the bottom of said pocket to engage an elongate structure.

2. The card holder of claim 1, wherein said clip comprises elongate, bendable material.

3. The card holder of claim 1, wherein said first major panel and said second major panel are of similar dimensions and shape.

4. The card holder of claim 3, wherein said main body is substantially symmetrical on either side of the longitudinal axis of said holder.

5. A transaction card holder assembly comprising:

a transaction card holder including a main body, said main body including a first major and a second major panel each connected to a pocket therebetween, said major panels pivotable about the outer edges of said pocket, said pocket of sufficient length to receive an edge of a transaction card, a clip projecting outwardly from the bottom of said pocket to engage an elongate structure, a backer for receiving and holding said holder, said backer including a main panel with an elongated slot therein sized to receive said pocket within, a major panel of said main body passed through said slot until said pocket rests within said elongated slot.

6. The assembly of claim 5, wherein said clip comprises elongate, bendable material.

7. The assembly of claim 5, wherein said backer further comprises a subpanel attached to the back surface of said main panel to substantially underlie said main panel.

8. The assembly of claim 5, wherein said main panel includes a line of perforations running from a margin of said elongate slot to a margin of said main panel, whereby upon tearing or cutting along said line of perforations said slot is opened and said transaction card holder released from said backer.

9. A transaction card holder assembly comprising:

a transaction card holder including a main body, said main body including a first major and a second major panel each connected to a pocket therebetween, said major panels pivotable about the outer edges of said pocket, said pocket of sufficient length to receive an edge of a transaction card, a clip projecting outwardly from the bottom of said pocket to engage an elongate structure, and a backer for receiving and holding said holder, said backer including a main panel with an elongated slot therein sized to receive said pocket within, said first major panel passed through said slot until said pocket rests within said elongated slot.

* * * * *